United States Patent [19]

Pastva

[11] Patent Number: 5,050,916

[45] Date of Patent: Sep. 24, 1991

[54] DOOR AND DOOR CONTROL MECHANISM

[75] Inventor: John V. Pastva, Parma Heights, Ohio

[73] Assignee: The Eastern Company, Cleveland, Ohio

[21] Appl. No.: 426,737

[22] Filed: Oct. 24, 1989

[51] Int. Cl.[5] ..... E05C 3/06

[52] U.S. Cl. ..... 292/217; 160/213; 292/218

[58] Field of Search ..... 292/44, 54, 218; 49/395; 160/210, 213

[56] References Cited

U.S. PATENT DOCUMENTS

| | | | |
|---|---|---|---|
| 382,934 | 5/1888 | Arms | 160/213 |
| 952,966 | 3/1910 | Volk et al. | 160/213 |
| 2,442,031 | 5/1948 | Beauchamp | 292/217 |
| 2,765,189 | 10/1957 | Forssell | 292/218 |
| 2,783,080 | 2/1957 | Ringsby . | |
| 2,995,400 | 8/1961 | Posivio . | |
| 3,099,473 | 7/1963 | Pastva, Jr. . | |
| 3,484,127 | 12/1969 | Pastva | 292/54 X |
| 3,695,331 | 10/1972 | McClain | 160/213 X |
| 3,695,661 | 10/1972 | Pastva . | |
| 3,737,183 | 6/1973 | Pastva, Jr. . | |
| 4,601,501 | 6/1986 | Pastva . | |
| 4,742,701 | 5/1988 | Scavetto . | |
| 4,753,466 | 6/1988 | Umebachi et al. | 292/218 |
| 4,877,276 | 10/1989 | Pastva | 292/218 |
| 4,889,372 | 12/1989 | Dege et al. | 292/218 |

OTHER PUBLICATIONS

Trucks magazine, "A Northeast Niche", p. 14.

Container News, Aug. 1976, "Hypobaric—A New Name in Container/Storage Systems for Perishable Commodities", pp. 12–13.

*Primary Examiner*—Gary L. Smith

*Assistant Examiner*—Michael J. Milano

*Attorney, Agent, or Firm*—Watts Hoffmann Fisher & Heinke

[57] ABSTRACT

An improved door and door control mechanism combinations for cargo carrying containers. In one embodiment a single door of one rigid panel closes the entire end of the container. In another embodiment the door is formed of two rigid panels hinged together. In both embodiments, the door is hinged to only one vertical side of the container frame structure and is latched to the frame at plural locations along upper and lower horizontal edges of the door and also along the vertical distal edge of the door.

6 Claims, 4 Drawing Sheets

DOOR AND DOOR CONTROL MECHANISM

TECHNICAL FIELD

The present invention provides improved door and door control mechanism combinations for cargo carrying containers.

BACKGROUND OF THE INVENTION

Cargo carrying containers, such as truck trailers or containers, commonly use rectangular pivoted double doors on a rear end wall for loading and unloading cargo from the container. Because the doors generally comprise the entire rear end wall of the container, there is little bracing or other container support, and the frame is thus easily subjected to rack distortion. Once the frame is distorted, proper engagement between the doors and frame is often difficult to achieve and maintain. Various door control mechanisms have been used in the past to urge the doors to the closed position, and to resist and reduce racking once the doors are closed.

Such mechanisms are disclosed, for example, in U.S. Pat. Nos. 3,695,661 and 4,601,501. They include lock rods or shafts mounted on and extending the height of the door. The shafts include cam members secured to opposite shaft ends for engagement with keeper members mounted on the associated door frame. Often two lock rods or additional latch members extending laterally from the shafts have also been provided, as in U.S. Pat. No. 3,737,183, at locations intermediate the cam and keeper members. These intermediate latch members are provided to further assist in aligning and closing the doors, and are positioned to bridge the central juncture between two pivoted doors. The latch member extends from a shaft secured to one door, while the associated keeper is secured to an adjacent door for engagement by the latch member.

SUMMARY OF THE INVENTION

The present invention provides improved door and door control mechanism combinations for cargo carrying containers.

In one embodiment a single door of one rigid panel closes the entire end of the container. In another embodiment the door is formed of two rigid panels hinged together. In both embodiments, the door is hinged to only one vertical side of the container frame structure and is latched to the frame at plural locations along upper and lower horizontal edges of the door and also along the vertical distal edge of the door. In the embodiment in which the door has two panels, only one is hinged to the frame and the other is hinged to the distal edge of the first panel so it can be folded back against it. In both embodiments there are first and second door control mechanisms for controlling pivotal movement of the door between a closed position where the door closes the opening and an open position where the door is away from the opening. The first door control mechanism is located adjacent a vertical distal side edge of the door and the second is located intermediate the vertical edge that is pivoted to the frame and the first door control mechanism. Each door control mechanism includes a vertical shaft pivotably secured to the door, operating means connected to the shaft for rotating the shaft, latching members secured to opposite ends of the shaft, and corresponding keeper members for cooperating engagement with the latching members and secured to upper and lower edges of the frame structure. The first door control mechanism has an additional latch connected to and extending laterally from the shaft member, positioned intermediate the opposite shaft ends for pivotal movement about an axis substantially parallel with but offset from the axis of the shaft, and a keeper on the frame structure adjacent the distal edge of the door when closed, engageable by the additional latch for latching the door in a closed position.

In the preferred embodiments, the latching members secured to opposite ends of the shaft are cam-type members that in operation engage keepers before the door is tightly closed and exert a closing force and inhibit relative shifting of the door within the frame structure when the door is closed and latched. Preferably the latching members secured to opposite ends of the shafts have camming surfaces that act against the keepers to exert an aligning force between the door and frame as the door is tightly closed. In the preferred embodiments, those latching members include forked portions having tines. The tines of the second door control mechanism, located intermediate the pivoted edge of the door and the distal edge, are longer than the tines of the first door control mechanism. This facilitates early engagement between the tines and keepers of the second door control mechanism when the door is only partially closed, and serves to progressively align the door and frame during closure, a feature particularly advantageous for a single panel door spanning the entire width of the back end of the cargo container. The tines of the cam at the first latch mechanism are kept shorter, to provide greater vertical strength for rigidity at the distal edge of the door.

The additional latch that is located intermediate the ends of the operating rod or shaft of the first latch mechanism serves to engage the frame at the distal end of the door, exerting a force when latched that draws the door and frame together. This latch compresses a gasket between the door and frame to enhance the seal provided between the two. This is especially helpful on a large door that closes the entire end of a cargo container, because typically the door will have some degree of warp and need closing pressure applied midway along the distal vertical edge.

Because the present one piece door is no thicker than the conventional double doors used on trucks and containers, when this door is opened and swung completely around, against the side of the cargo container, as is done for unloading and loading, the overall width of the container is less, by the thickness of the door and the clearance provided by the hinges, than a cargo container having two doors, each hinged on an opposite vertical edge of the rear opening. Accordingly, the cargo container of the present invention, with its reduced width, has greater clearance at loading docks and hence is easier to back into position. Further, the plural lock rods on a single door provide additional security. In addition, fewer hinges are required, fewer door hold backs, and less labor is required for assembly and installation. In addition, gasket reduction is achieved by avoiding the central junction between two end doors.

The embodiment in which two panels are hinged vertically can provide access to the interior of the cargo container without opening the entire end. Also, the entire end can be opened in two steps, as, for example, if there is substantial wind making it very difficult to handle a large door the full width of the end. In this embodiment, the entire door can be folded against one side of the container in its fully extended position, again achieving the savings in width clearance with the door open.

Other features and advantages of the present invention will become apparent from the following detailed description of a preferred embodiment made with reference to the accompanying drawings forming part of the specification.

BEST MODE FOR CARRYING OUT THE INVENTION

Figure 1:
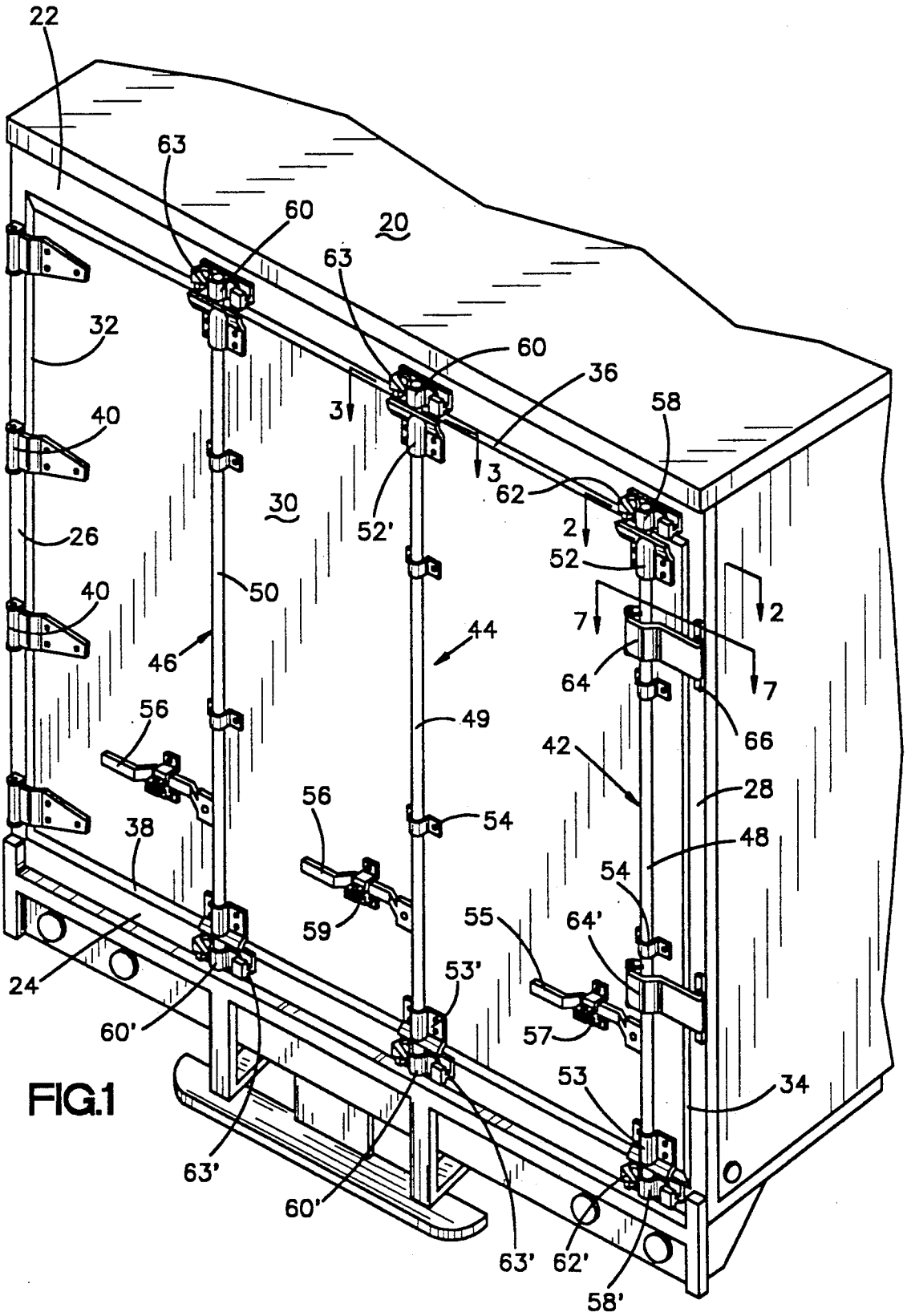
FIG. 1 is a partial isometric view of the back end of a truck trailer showing a preferred embodiment of the present invention.

A preferred embodiment of the present invention, as embodied in a truck trailer, is shown in FIG. 1. A cargo carrying container 20 has a rectangular vertical access opening defined by a header 22, a transom 24, and vertical side frame members 26 and 28. A one piece door 30 having a vertical pivoted edge 32, a vertical free or distal edge 34, and top and bottom edges 36 and 38 respectively, is pivotably secured to one side of the frame structure 26 by hinges 40 along the vertical pivoted edge 32.

First, second, and third door control mechanisms, indicated generally at 42, 44, and 46, respectively, control pivotal movement of the door between a closed position and an open position. Each door control mechanism 42, 44, and 46 includes a pivotable shaft 48, 49, and 50, respectively, that extends vertically along the outside surface of the door from below the bottom edge 38 to the top edge 36 of the door. The second door control mechanism and the third door control mechanism are identical and therefore only the first and second door control mechanisms 42, 44 will be described in detail.

The door control mechanisms 42, 44 include upper 52, 52', and lower 53, 53' bearing members and intermediate bearing brackets 54, which secure the shafts 48, 49 to the door for pivotable movement about the longitudinal axis of the shaft; handles 55, 56 secured to and extending laterally from each shaft 48, 49; and a handle retainer comprised of a seal plate and seal pin assembly 57, 59 for securing the handles in a fixed position relative to the door. The first door control mechanism 42 includes upper and lower latching cams 58 and 58', which are secured to opposite ends of the shaft 48. Keepers 62, 62' which are secured to the door frame members 22, 24, cooperate respectively with the upper and lower latching cams. Similarly, the shaft 49 of the second door control mechanism has secured to it at opposite ends upper and lower latching cams 60 and 60'. Keepers 63, 63' cooperate with the upper and lower latching cams 60 and 60'. The latching cams of each door control mechanism 58, 58' and 60, 60', cooperate with their respective keepers 62, 62' and 63, 63' to retain the door 30 in a closed position and to align, and to maintain alignment, of the door with the frame. The shafts can be pivoted by the handles 55, 56 to pivot the latching cams 58, 58', and 60, 60', into and out of engagement with their respective keeper 62, 62' and 63, 63'.

The first door control mechanism 42 is located adjacent a vertical distal side edge 34 of the door, and the second door control mechanism 44 is located intermediate the pivoted vertical edge 32 of the door 30 and the first door control mechanism 42. The third door control mechanism 46 is located intermediate the second door control mechanism 44 and the pivoted vertical edge 32 of the door 30.

Two additional latches 64, 64' each have an end pivotably connected to and eccentrically of the shaft 48 intermediate its ends, and are operated by the handle 55 along with the cams 58, 58'. As the latches 64, 64' are identical, only the latch 64 will be described in detail. The latch 64 cooperates with an intermediate keeper 66 on the frame member 28 adjacent the distal edge 34 of the door 30 and a guide member 68 secured to the door 30 adjacent to the non-pivoted or distal side edge 34 thereof, for assisting in the aligning and closing of the door.

As best shown in FIGS. 2-5, the latching cams 58, 58', and 60, 60', on opposite ends of the shafts 48, 49, engage the keepers 62, 62' and 63, 63'. The members exert a closing and aligning force and then inhibit relative shifting of the door 30 within the frame structure when the door is closed and latched.

Figure 2:
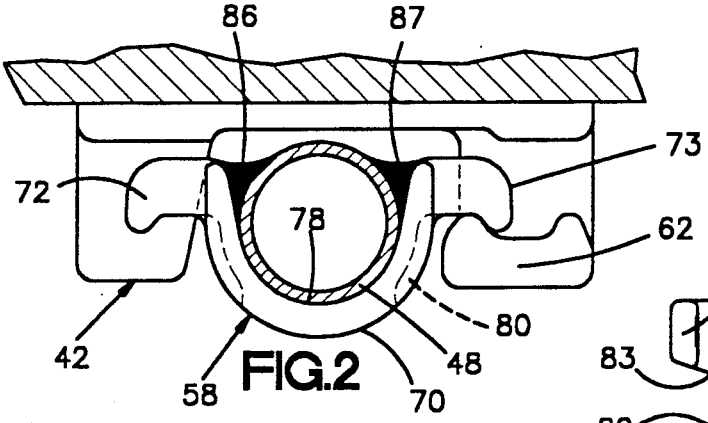
FIG. 2 is a view partially in section of one pair of latching and keeper members used in the door control mechanism of FIGS. 1 and 11 as viewed along the line 2—2 of FIG. 1.
Figure 4:
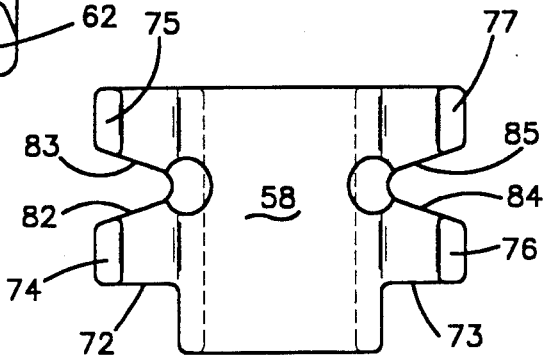
FIG. 4 is a front view of the latching member of FIG. 2.

The upper and lower latches 58, 58', of the first door control mechanism are identical, and only the latch 58 will be described in detail. As best shown in FIGS. 2 and 4, the latch 58 of the first door control mechanism 42 includes a central U-shaped body portion 70 and two forked portions 72, 73 extending from the central body portion in opposite directions. The latch is symmetrical about a central plane that includes the central axis of the latch, which coincides with the central axis of the shaft 48 when the latch is assembled to the shaft. In the preferred embodiment, in which the lock rod is cylindrical in shape, the central body portion 70 of the latch is in the form of a section of a circular cylinder, open axially, forming a recess 78 that extends the length of the central body and is adapted to receive the shaft 48. The recess 78 is at a maximum width at the axial opening. The central body portion 70 extends axially in one direction beyond the forked portions to form a partial boss 80 that serves as a bearing surface. Each forked portion 72, 73 has two projections 74, 75 and 76, 77, respectively, mutually opposed to the other and which together converge toward the central body. Each projection 74, 75 has a surface 82, 83, respectively, mutually opposed to the other, which together converge toward the central body. Similarly, each projection 76, 77 has a surface 84, 85, respectively, mutually opposed to the other, which together converge toward the central body. The projections 74, 75, 76 and 77 are curved in a direction away from that in which the axial opening faces and all terminate in a common plane that intersects the central body portion 70, as will be evident from FIG. 2. The curvature of the fork projections is insufficient to produce a re-entrant angle. This, plus the shape of the recess 78 of the central body portion, which is widest at the opening, as well as other particular aspects of the construction evident from the drawings, makes the part particularly suitable for forging. The latch is assembled to the shaft 48 by positioning the end of the shaft within the recess 78 and welding the shaft and latch together at the weld portions 86, 87, shown in FIG. 2.

Figure 3:
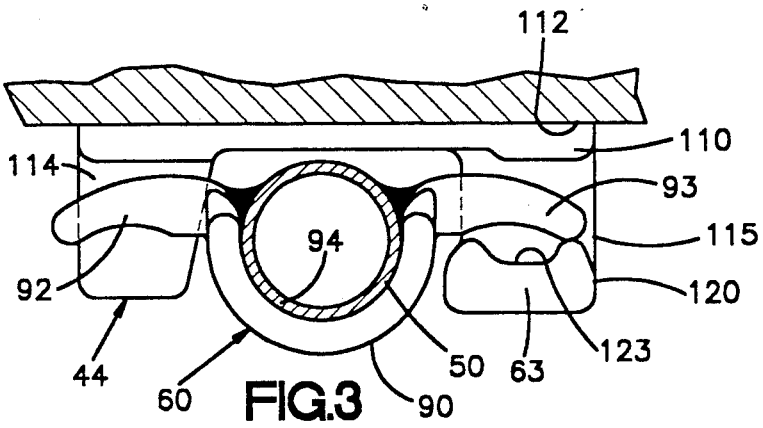
FIG. 3 is a sectional view of another pair of latching and keeper members used in the door control mechanism of FIGS. 1 and 11 as viewed along the line 3—3 of FIG. 1.
Figure 5:
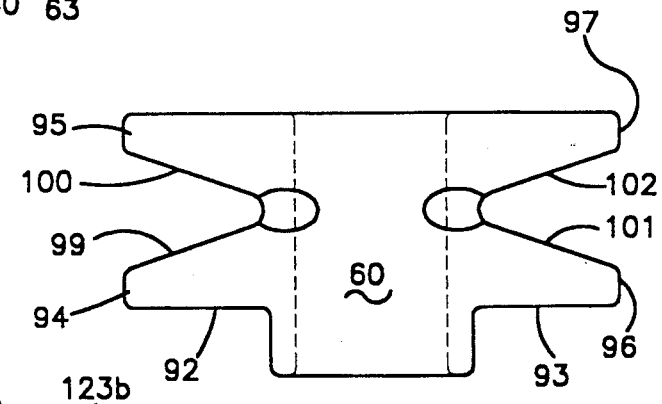
FIG. 5 is a front view of the latching member of FIG. 3.

The upper and lower latches 60, 60', of the second and third door control mechanisms are identical, and only the latch 60 of the second door control mechanism will be described in detail. As best shown in FIGS. 3 and 5, latch 60 of the second door control mechanism 44 also includes a central U-shaped body portion 90 and two forked portions 92, 93 extending from the central body portion in opposite directions. The latch 44 is also symmetrical about a central plane that includes the central axis of the latch, which coincides with the central axis of the shaft 49 when the latch is assembled to the shaft. In the preferred embodiment, in which the lock rod is cylindrical in shape, the central body portion 90 of the latch is in the form of a section of a circular cylinder, open axially, forming a recess 98 that extends the length of the central body and is adapted to receive the shaft 49. Each forked portion 92, 93 has two projections 94, 95 and 96, 97, respectively. Each projection 94, 94 has a surface 99, 100, respectively, mutually opposed to the other and which together converge toward the central body. Similarly, the projections 96, 97 have surfaces 101, 102, mutually opposed to the other and which converge toward the central body. The surfaces 99, 100 and 101, 102 are curved in a direction away from that in which the axial opening faces. In the preferred embodiment, the length of the projections 94, 95 and 96, 97 are longer relative to the length of the projections 74, 75 and 76, 77 of latch 58 of the first door control mechanism.

Figure 6:
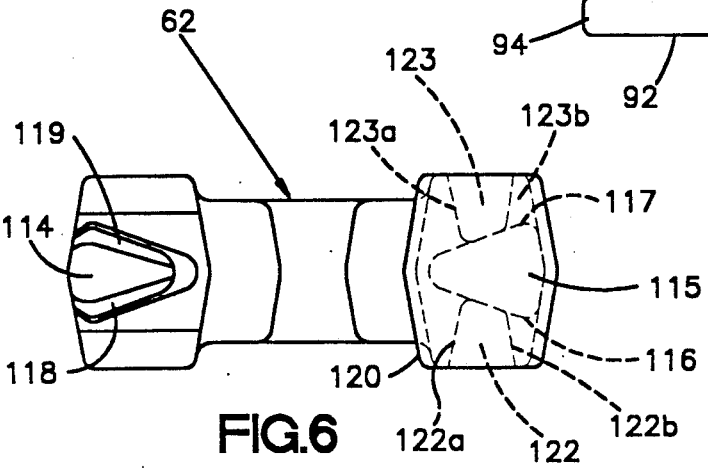
FIG. 6 is a front view of the keeper member of FIGS. 2 and 3.

The keepers 62, 62' and 63, 63' of the door control mechanisms 58, 58' and 60, 60' that cooperate with the latching cams are identical, and only the keeper 63 will be described in detail. Referring to FIGS. 3 and 6, each keeper 63 includes a base portion 110 with a flat bottom surface 112 for placement against the door frame aligned with and directly opposite from the associated cam. The keepers are either welded to the door frame or are provided with apertures in the base to facilitate attachment with fasteners. Two spaced posts or post portions 114, 115 extend outwardly from the base portion adjacent opposite ends thereof and are constructed to be straddled by the forked portions 72, 73 of cam latch 58, or 92, 93 of the cam latch 60, and to permit pivoting of the respective cam latch relative to the posts, into and out of a straddling position. As best shown in FIG. 6, the post 115 has two side surfaces 116, 117 that are perpendicular to the bottom surface 112 of the base portion and that converge toward each other in the direction of the other post 114. The post 114 has two side surfaces 118, 119 that converge toward one another in the direction of the other post 115 and which also slope toward one another in an outward direction from the base portion 110 so that the post tapers outwardly. The side surfaces 116, 117 and 118, 119 are adapted to cooperate with the inclined surfaces 82, 83 and 84, 85, respectively, of latch 58, or the surfaces 99, 100 and 101, 102 of the latch 60, respectively, as necessary, if the door is out of accurate alignment or if it tends to move out of alignment after the cam latch has been placed in a position to retain the door in a closed position. More particularly, as the cam latch 58, or cam latch 60, is rotated about the central axis of the cam body portion during latching, both forked portions 72, 73, or 92, 93, will cooperate with the posts 114, 115 of the keeper, if the door is out of alignment. One of the inclined surfaces 82 or 83 of the projections 74, 75 on the cam latch 58, or the surfaces 99 or 100 of the cam latch 60, will act against a side surface 118 or 119 of the post 114 to force the door on which the latch is carried up or down into a predetermined alignment. At the same time, one of the surfaces 84, 85 of the projections 76, 77, or the surfaces 101 or 102 of latch 60 will cooperate with one of the tapered surfaces 116, 117 of the post 115 to assist in forcing the door into a predetermined alignment. Once the cam latch is turned to a locking position, the same surfaces will cooperate to restrain movement of the door relative to the frame in the plane of the door. With the door so restrained against movement, the door becomes a structural reinforcing member for the container and adds rigidity to the entire assembly.

The door 30 is held in a closed position by a cam latch retaining flange 120 on the post 115 of each keeper. The retaining flange limits the rotation of the cam latch and prevents outward movement of the cam relative to the frame in the absence of latch rotation. The retaining flange 120 extends in opposite directions from the post 115, laterally with respect to the direction in which the side surfaces 116, 117 converge. It is spaced from the base portion 110 a distance sufficient to receive the projections 76, 77 that form the forked portion 73 of the cam latch 58, or the projections 96, 97 that form the forked portion 93 of the latch 60, yet close enough to the base portion to hold the door 30 tightly against the frame and preferably close enough to limit rotation of the respective cam latch and shaft before the handles 55, 56 are against the door 30 so that a slight torsion loading can be applied to the respective shaft 48 or 49, by a handle 55 or 56 when the handle is forced into a position where it is retained by the seal plate and seal pin assembly 57, 57'. Concave surface portions 122, 123 are formed in the surface of the cam latch retaining flange that faces the base portion of the keeper, on opposite sides of the post portion, between spaced, depending, transversely extending, shoulder portions **122*a*, 122*b* and 123*a*, 123*b*. In the preferred embodiment shown, the concave surface portions and the shoulder portions are formed of straight-line elements extending substantially perpendicular to the direction in which the side surfaces 116, 117 of the post converge. The concave surface portions are constructed to receive the upturned ends of the projections 76, 77 of the forked portion 73 of the latching cam 58. As a result, the end of the forked portion 73 of the first latching mechanism 42 is covered by the flange portion 120 and is located inwardly of the adjacent end of the keeper, between the shoulder portions, isolated against direct application of outside forces. In the preferred embodiment, and as best shown in FIG. 3, the projections 96, 97 of the second latch 44, and the third latch 46, extend laterally for a distance beyond the flange portion 120 when the latch 44 and keeper 63, 63' are engaged. The length of these projections, as well as their location relative to the pivoted edge 32 of the door, permits the latches and keepers of the second and third door control mechanisms to engage sooner, while the door is still partially open, than if constructed the same as the first door control mechanism. As will be apparent from the above description and the construction shown in the drawings, the keeper members 62, 62', 63, 63'** are of a shape suitable for forging and therefore can be manufactured relatively inexpensively.

Figure 7:
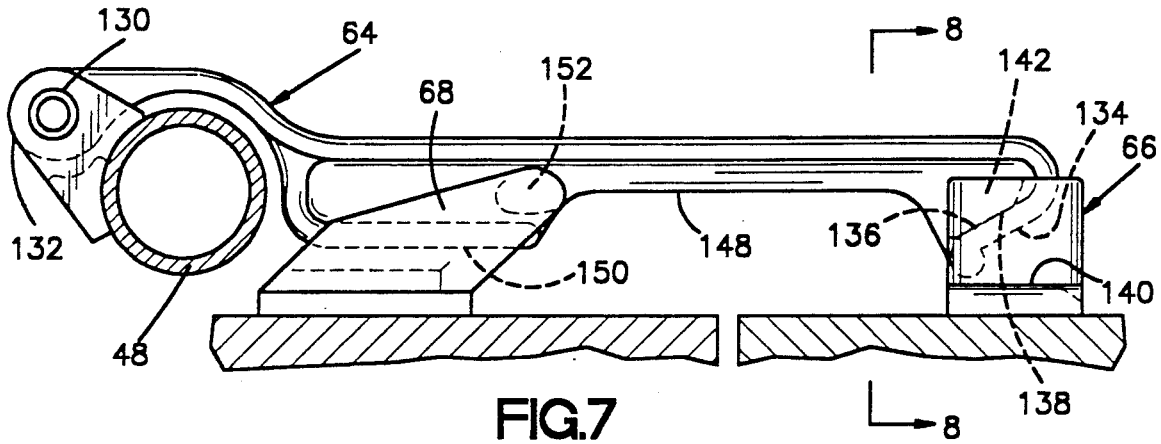
FIG. 7 is a top view partially in section of an additional latch of the invention of FIGS. 1 and 3 as viewed along the line 7—7 of FIG. 1.
Figure 8:
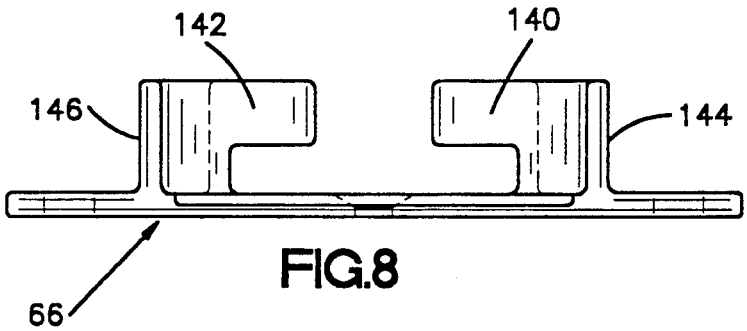
FIG. 8 is a side elevational view of the keeper member of the third latch of FIG. 4 as viewed along the line 8—8 of FIG. 7.
Figure 9:
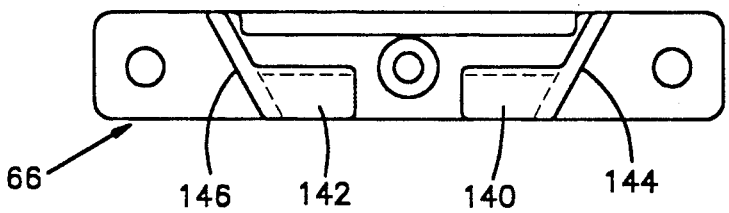
FIG. 9 is a front view of the keeper member of FIG. 8.
Figure 10:
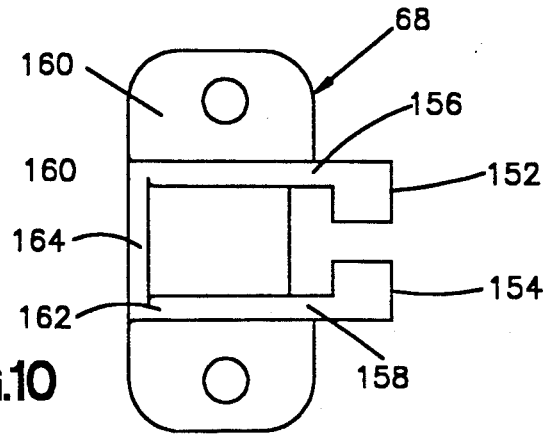
FIG. 10 is a front view of the guide member of the latch of FIG. 7.

Referring now to FIG. 1, the intermediate or additional latch 64 is a rectangularly shaped, strap or plate-like member, the left-hand end of which overlies and is eccentrically connected to the shaft 48 by a pivot pin 130 carried by a clevis-like member 132 welded to the shaft 48. The opposite end or left-hand end of the member 64 has an inturned or reversed bent portion 134 projecting inwardly and towards the shaft 48 from the main body portion of the member and providing cam surface 136 diverging from the main body portion towards the shaft adapted when the door is closed to engage cooperating cam surfaces 138 on the underside of spaced projections 140, 142 on forwardly extending portions 144, 146 of the keeper member 66. The members 140, 142 extend from the portions 144, 146 of the keeper towards one another and at least the undersides 138 thereof, i.e., the sides toward the plane of the door 30, are inclined outwardly and away from the free edge 34 of the door, as shown in FIG. 7.

The strap-like member 64 has on the side thereof adjacent the doors, a reinforcing rib or flange 148 running lengthwise of the member and on the same side a flange or projection 150 extending toward the right, as viewed in the drawings, from a point near the rod or shaft 48. The flange 150 extends generally parallel to the main body part of the member 64 and is spaced therefrom a distance to provide clearance between the flange and the main body portion of the member for inwardly extending members 152, 154 of the guide member 68. The members 152, 154 extend inwardly toward the central reinforcing flange 148 of the member 64 from side portions 156, 158 of the guide member projecting forwardly from a base 160.

The construction of the member 64 is such that, as the member 64 is moved upon rotation of the rod or shaft 48, it not only pivots about the pivot pin 130 but it slides and pivots relative to the projections 152, 154, which projections also limit its pivotal movement about the pivot 136. The length and location of the flange 150 is such that the body portion of the member 64 provides an aperture or slot within which the projections 152, 154 extend without interfering with rotation of the rod or shaft 48 but within which they are always confined; i.e., between the flange 150 and the main body portion of the member 64. As the shaft 48 is oscillated the member 64 will pivot not only about the pin 130 but also about the projections 152, 154. As the shaft 48 is rotated in a clockwise direction, as viewed in FIG. 7, the member 64 will swing or pivot about the projections 152, 154, and the free end of the member 64, that is the end which engages the keeper 66, will move toward the plane of the door 30, until stopped by the keeper 66, and to the right, and the guide member 68, and the door move outwardly. As the door is closed, the movement of the member 64 will be in the reverse to that just referred to and the free or latch end of the member 64 will move to the left and toward the plane of the door 30, the inturned part 134 will engage underneath the projections 140, 142 of the keeper 66 to assist in closing the door, and the free end will then move away from the plane of the door into forceful contact with the keeper surfaces 138, forcing the door through contact with the guide member projections 152, 154 into the plane of the door frame, and also tensioning the door.

During movement of the door from the open to the closed position, the third door control mechanism 46 will operate to align and to close the door 30 prior to operation of the second and first door control mechanisms 44 and 42 respectively. The location of the third mechanism 46 intermediate the second mechanism 44 and the pivoted edge of the door 32 causes the latches and keepers of the mechanism 46 to engage first while the door is partially closed. When the handle 56 of the shaft 49 is then operated to cause the shaft 49 to rotate, the second door control mechanism 44 will operate to continue closing and aligning the door 30 prior to operation of the first door control mechanism 42 and the additional latch mechanisms 64, 64'. The longer length of the forked projections 94, 95, 96, and 97 of the second and third mechanisms 44 and 46 relative to the length of the projections 72, 73, 74, and 75 of the first mechanism, as well as the locations of the second and third mechanisms intermediate the first mechanism 42 and the pivoted edge of the door 30, cause the latches 60, 60' and keepers 63, 63' to engage while the door 30 is only partially closed. In this manner, alignment of the door 30 begins well prior to complete door closure, as is likely to be necessary with such a wide door, which amplifies the effect of any racking of the container and door frame. As the door is aligned and further closed by the second mechanism 44, operation of the handle 55 will cause the shaft 48 to rotate, and the latch 58 and keeper 62 of the first mechanism 44 will engage. At the same time, the additional latch 64 will be moved to engage with the keeper 66 to assist in the closing of the door. When the door is closed, this latch secures the door along its vertical height at the distal end 34, compresses a gasket 35 between the door 30 and the door frame, and resists separation between the frame and the door.

Figure 11:
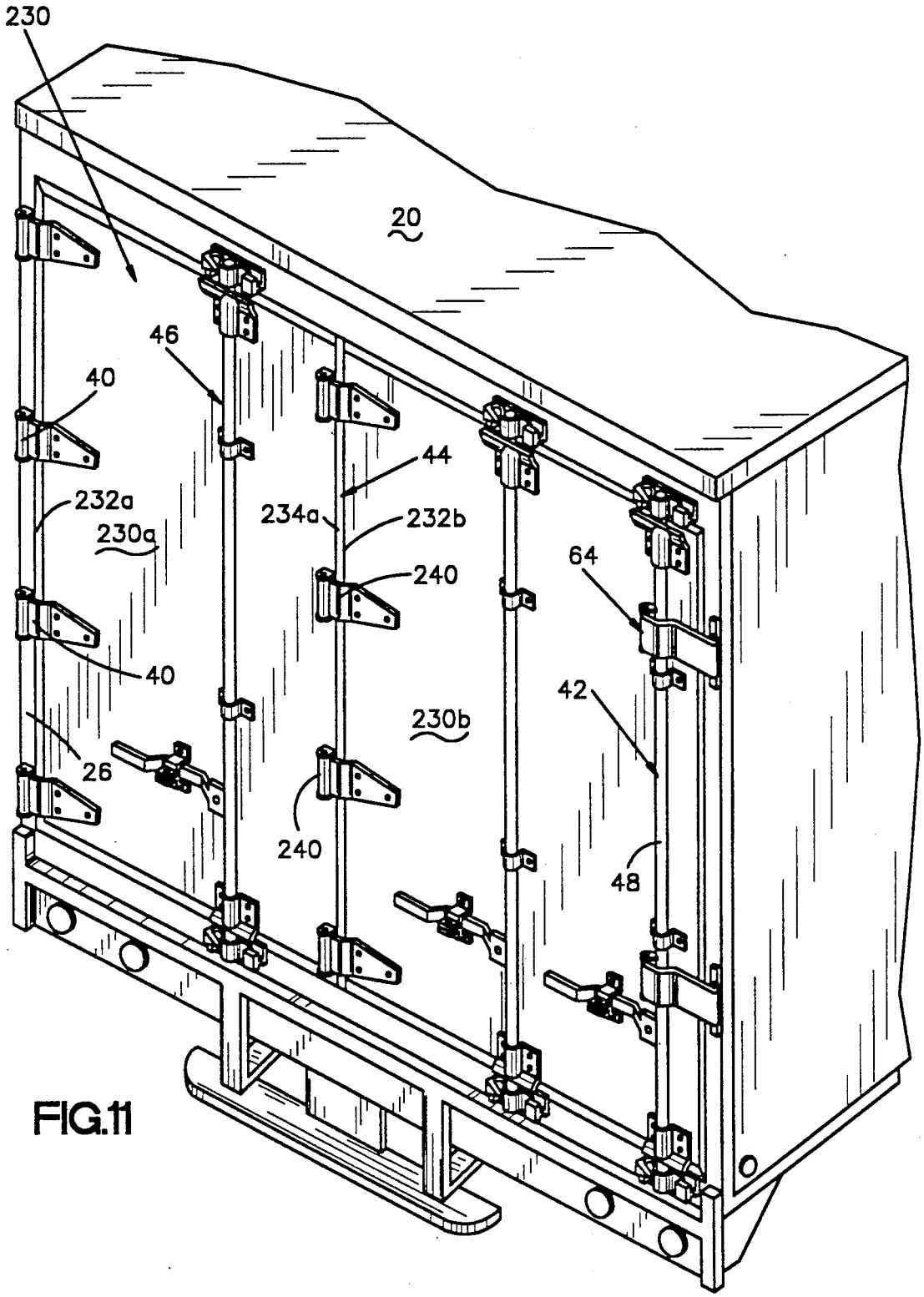
FIG. 11 is a partial isometric view of the back end of a truck trailer showing another preferred embodiment of the present invention.

In another embodiment, and as best shown in FIG. 11, the pivoted door, now indicated generally as 230, is comprised of first and second panels, **230*a* and 230*b*. The first panel 230*a* is pivotably secured to one side 26 of the frame structure by the hinges 40 along a first vertical side edge 232*a*. The second panel 230*b* has a first vertical side edge 232*b* that is pivotably secured by hinges 240 to the first panel 230*a* along a second vertical side edge 234*a* of the first panel. The hinges and door panels are constructed and arranged so the panel 230*b* can be folded outwardly and against the panel 230*a*, but cannot be pivoted in the other direction beyond the coplanar relationship shown, so that one hinged juncture will not buckle outward. First, second, and third door control mechanisms 42, 44, and 46 control pivotal movement of the door 240 between a closed position and an open position. The first door control mechanism 42 is located adjacent a second vertical side edge 234*b* of the second panel 230*b*. The second door control mechanism 44 is located intermediate the first door control mechanism 42 and the first vertical side edge 232***b* of the second panel 230*b*. The third door control mechanism is located intermediate the first vertical side edge 232*a* and the second vertical side edge 234*a* of the first panel 230*a*. The door control mechanisms 42, 44, and 46 are identical in all respects to the door control mechanisms described for the first embodiment, including the additional latches 64, 64'.

In operation, the door 230 can be opened in two manners. In one manner, the entire door 230 can be opened flat, i.e., in an extended position alongside the container. In the second manner, the hinges 240 between the panels 230*a* and 230*b* permit the second panel 230*b* to swing outward from the door frame while limiting pivoting of the panels relative to each other so that the panels do not buckle outward when the door is closed. The hinges 240 only permit pivoting from the flat plane of the door frame in one direction so that the door 230 can swing back on itself, and of course the whole door can be opened flat, i.e. without pivoting about the hinges 240.

While preferred embodiments of the invention have been disclosed in detail, the present invention is not to be considered limited to the precise constructions disclosed herein. Various adaptations, modifications and uses of the invention may occur to those skilled in the art to which the invention relates and the intention is to cover all such adaptations, modifications and uses falling within the spirit or scope of the appended claims.

I claim:

1. A cargo carrying container comprising, a) a rectangular substantially vertical access opening at one end, comprising essentially the entire end and defined by a frame structure, b) a one-panel pivoted door for closing said opening, having a vertical side edge pivotably secured to one side of the frame structure, and c) first and second door control mechanisms for controlling pivotal movement of the door between a closed position wherein the door closes the opening, and an open position wherein the door is away from the opening, said first door control mechanism being located adjacent a vertical distal side edge of the door and the second being located intermediate the pivoted vertical edge and the first door control mechanism, d) each said door control mechanisms including a vertical shaft pivotably secured to the door, operating means connected to the shaft for rotating the shaft, cam-type latching members secured to opposite ends of the shaft, and corresponding keeper members for cooperating engagement with said latching members and secured to upper and lower edges of the frame structure, said latching members including forked portions having tines, the tines of the second door control mechanism being longer than tines of the first, said latching members in operation engaging the keepers before the door is tightly closed and exerting a closing force and having camming surfaces that act against the keepers to exert an aligning force between the door and frame as the door is tightly closed and that inhibit relative shifting of the door within the frame structure when the door is closed and latched, and e) the first door control mechanism having an additional latch connected to and extending laterally from the shaft member, and positioned intermediate the opposite shaft ends for pivotal movement about an axis substantially parallel with but offset from the axis of the shaft, and a keeper on the frame structure adjacent the distal end of the door when closed, engageable by the additional latch for latching the door in a closed position.

2. The cargo carrier of claim 1 wherein the additional latch includes a guide that allows movement of the latch laterally of the shaft member to which it is pivoted while limiting relative rotational movement of the latch member.

3. A cargo carrying container comprising, a) a rectangular substantially vertical access opening at one end, comprising essentially the entire end and defined by a frame structure, b) a pivoted door comprising first and second panels, the first having a first vertical side edge pivotably secured to one side of the frame structure and a second vertical side edge to which the second panel is pivotably secured, and the second panel having a first vertical side edge pivotably secured to the first panel, c) first and second door control mechanisms for controlling pivotal movement of the door between a closed position wherein the door closes the opening, and an open position wherein the door is away from the opening, said first door control mechanism being located adjacent a vertical distal side edge of the second panel and the second door control mechanism being located intermediate the first and second vertical side edges of the first panel, d) said door control mechanisms each including a vertical shaft pivotably secured to a panel of the door, operating means connected to the shaft for rotating the shaft, latching members secured to opposite ends of the shaft, and corresponding keeper members for cooperating engagement with said latching members secured to upper and lower edges of the frame structure, said latching members having elongate tines and the tines of the second door control mechanism being longer than the tines of the first, and e) the first door control mechanism having an additional latch connected to and extending laterally from the shaft member intermediate the opposite shaft ends for pivotal movement about an axis substantially parallel with but offset from the axis of the shaft, and a keeper on the frame structure adjacent the distal end of the door when closed, engageable by the additional latch for latching the door in a closed position.

4. The cargo carrying container of claim 3 wherein the second panel is secured to the first panel by hinges which allow the second panel to pivot outward from the door opening while the first panel is latched in a closed position.

5. The cargo carrying container of claim 3 further comprising a third door control mechanism located intermediate the first vertical side edge and the second vertical side edge of the first panel of the pivoted door.

6. A cargo carrying container comprising, a) a rectangular substantially vertical access opening at one end, comprising essentially the entire end and defined by a frame structure, b) a one-panel pivoted door for closing said opening, having a vertical side edge pivotably secured to one side of the frame structure, and c) first and second door control mechanisms for controlling pivotal movement of the door between a closed position wherein the door closes the opening, and an open position wherein the door is away from the opening, said first door control mechanism being located adjacent a vertical distal side edge of the door and the second being located intermediate the pivoted vertical edge and the first door control mechanism, d) each said door control mechanisms including a vertical shaft pivotably secured to the door, operating means connected to the shaft for rotating the shaft, latching members secured to opposite ends of the shaft, and corresponding keeper members for cooperating engagement with said latching members and secured to upper and lower edges of the frame structure, said latching members being cam-type members that in operation engage keepers before the door is tightly closed and exert a closing force and inhibit relative shifting of the door within the frame structure when the door is closed and latched, said latching members of the second door control mechanism including forked portions having first and second pairs of elongate tines extending laterally from the latching member for a distance beyond the cooperating keeper member when the latching and keeper members are engaged, and e) the first door control mechanism having an additional latch connected to and extending laterally from the shaft member, and positioned intermediate the opposite shaft ends for pivotal movement about an axis substantially parallel with but offset from the axis of the shaft, a guide that allows movement of the latch laterally of the shaft member to which it is pivoted while limiting relative rotational movement of the latch member, and a keeper on the frame structure adjacent the distal end of the door when closed, engageable by the additional latch for latching the door in a closed position.

* * * * *